US006142395A

United States Patent [19]

Reiter

[11] Patent Number: 6,142,395

[45] Date of Patent: Nov. 7, 2000

[54] FUEL INJECTION VALVE AND METHOD FOR MANUFACTURING A FUEL INJECTION VALVE

[75] Inventor: Ferdinand Reiter, Markgroeningen, Germany

[73] Assignee: Robert Bosch GmbH, Stuttgart, Germany

[21] Appl. No.: 09/339,442

[22] Filed: Jun. 24, 1999

[30] Foreign Application Priority Data

Jul. 1, 1998 [DE] Germany ..... 198 29 380

[51] Int. Cl.[7] ..... F02M 51/00; B05B 1/30

[52] U.S. Cl. ..... 239/585.1; 239/585.3; 239/585.4; 239/585.5; 251/129.21

[58] Field of Search ..... 239/585.1, 585.2, 239/585.3, 585.4, 585.5; 251/129.21

[56] References Cited

U.S. PATENT DOCUMENTS 4,454,990 6/1984 Lewis .
5,280,773 1/1994 Henkel ..... 251/129.06 X
5,289,627 3/1994 Cerny et al. ..... 239/585.5 X
5,775,600 7/1998 Wildeson et al. ..... 239/585.1 X

*Primary Examiner*—Andres Kashnikow
*Assistant Examiner*—Robin O. Evans
*Attorney, Agent, or Firm*—Kenyon & Kenyon

[57] ABSTRACT

In a fuel injection valve, after a preliminary adjustment of the valve seat support and immobilization thereof on the valve housing by way of a flanged rim, the effective stroke of the valve needle is measured, with the magnet coil energized, using an electrical displacement measurement system, and compared in the electronic control device to the reference stroke. In the event of a difference between these two values, the electronic control device activates a welding device which generates in an adjusting segment a first circumferential weld bead whose shrinkage upon cooling results in a decrease in the effective stroke. If, in a new measurement and adjustment cycle, the effective stroke still differs from the reference stroke, further weld beads are generated. The fuel injection valve is suitable particularly for the injection of fuel directly into the combustion chambers of internal combustion engines.

16 Claims, 1 Drawing Sheet

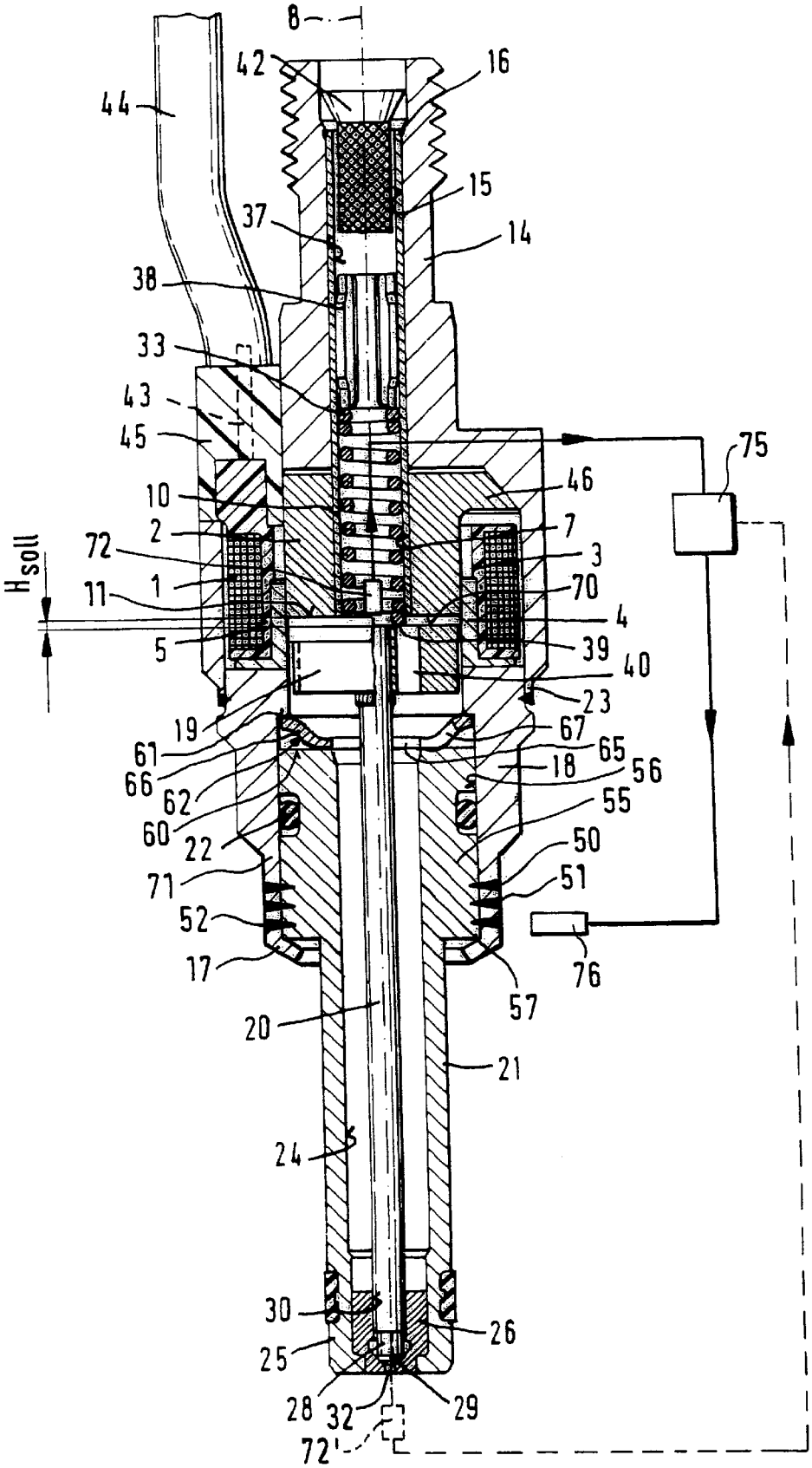
8
42
16
44
15
37
14
38
33
43
45
75
46
10
7
2
3
72
70
$H_{soll}$
11
1
4
5
39
40
23
19
67
61
65
66
18
56
62
55
60
22
50
71
51
52
17
76
57
20
21
24
30
26
25
28
32
29
72'

FUEL INJECTION VALVE AND METHOD FOR MANUFACTURING A FUEL INJECTION VALVE

BACKGROUND INFORMATION

U.S. Pat. No. 4,454,990 describes a fuel injection valve in which the valve seat element is arranged in a valve seat support and rests with its one end against a washer spring which is braced against the valve seat support, while its other end rests against a perforated element. The perforated element is mounted rotatably by way of a thread in the valve seat support, so that the valve seat element can be axially displaced in the valve seat support by rotation of the perforated element, thus changing the axial position of the valve seat surface. The linear stroke of the valve closure member can be adjusted by way of the change in the axial position of the valve seat surface. This kind of configuration of the fuel injection valve for adjusting the linear stroke of the valve closure member requires a high level of production complexity, can be configured with sufficient sensitivity only with great effort, and creates additional sealing problems.

SUMMARY OF THE INVENTION

The fuel injection valve and the method for manufacturing a fuel injection valve according to the present invention have the advantage that the linear stroke of the valve closure member can be adjusted easily, economically, and sensitively.

It is particularly advantageous to equip the valve seat support with a shoulder against which a flanged rim of the adjusting segment of the valve housing engages, so that when the fuel injection valve is assembled there is an immobilization between valve seat support and valve housing in which the linear stroke of the valve closure member is greater, in a preliminary setting, than the desired reference stroke.

It is also advantageous to equip the cup spring with a central aperture, and to configure, proceeding outward therefrom, a spring rim which extends in an S-shape, so that the cup spring does not dig into the contact surfaces in the valve housing or on the valve seat support.

In order to improve fuel flow, it is advantageous to equip the spring rim with at least one rim aperture, for example to perforate it or equip it with radially extending spring arms. Advantageously, the at least one weld bead can be configured in completely circumferential fashion or, for more sensitive adjustment, can be configured from weld bead segments with interruptions.

Another advantageous embodiment involves repeating the application of the weld bead on the adjusting segment of the valve housing, so that the reference stroke of the valve closure member is adjustable in very small adjusting steps which lie in the micrometer range.

BRIEF DESCRIPTION OF THE DRAWINGS

The FIGURE shows a fuel injection valve according to the present invention.

DETAILED DESCRIPTION

The FIGURE shows an exemplary embodiment of an electromagnetically actuated valve in the form of a fuel injection valve for fuel injection systems of mixture-compressing, spark-ignited internal combustion engines. A tubular, largely hollow-cylindrical core 2 serves as the inner pole of a magnetic circuit and is at least partially surrounded by a magnet coil 1. The fuel injection valve is suitable in particular for direct injection of fuel into a combustion chamber of an internal combustion engine. A coil body 3, for example stepped, receives a winding of magnet coil 1 and allows, in combination with core 2 and with an annular, nonmagnetic spacer 4, which has an L-shaped cross section and is at least partially surrounded by magnet coil 1, a particularly compact and short configuration of the injection valve in the region of magnet coil 1. Spacer 4 projects with one limb in the axial direction into a step 5 of coil body 3, and with the other limb radially along a lower (in the drawing) end surface of coil body 3. Core 2 is made of magnetically conductive material.

A continuous longitudinal opening 7, which extends along a longitudinal valve axis 8, is provided in core 2. Also extending concentrically with longitudinal valve axis 8 is a thin-walled tubular sleeve 10 which passes through the inner longitudinal opening 7 of core 2 in the downstream direction at least as far as a lower end surface 11 of core 2. Sleeve 10 is located directly on the wall of longitudinal opening 7, and possesses a sealing function with respect to core 2. The nonmagnetic sleeve 10 is joined by welding or soldering to core 2, so that no fuel can flow between core 2 and sleeve 10. Together with core 2, which is also joined in immovable and sealed fashion (for example by welding or brazing) to the limb of spacer 4 which extends in an axial direction, this encapsulation also ensures that magnet coil 1 remains completely dry when fuel is flowing through the valve.

Sleeve 10 also serves as a fuel conveying conduit, forming a fuel inlet fitting together with an upper metallic (e.g. ferritic) housing part 14 which largely surrounds sleeve 10. A passthrough opening 15, which for example has the same diameter as longitudinal opening 7 of core 2, is provided in housing part 14. Sleeve 10, which passes through housing part 14 and core 2 in the respective openings 7 and 15, is not only immovably joined to core 2 but also sealedly and immovably joined to housing part 14, for example by welding or crimping, at upper end 16 of sleeve 10. Housing part 14 forms the inflow end of the fuel injection valve, and encases sleeve 10, core 2, and magnet coil 1 at least partially in the axial and radial direction, and extends, for example in the axial direction when viewed downstream, even beyond magnet coil 1. Adjoining upper housing part 14 is a lower housing part 18 which encloses or receives, for example, an axially movable valve part comprising an armature 19 and a valve needle 20 or a valve seat support 21. The two housing parts 14 and 18 are immovably joined to one another in the region of lower end 23 of upper housing part 14, for example with a circumferential weld bead.

Lower housing part 18 and the largely tubular valve seat support 21 are immovably joined to one another, for example, by way of a flanged rim 17 and at least a first weld bead 50. Sealing between housing part 18 and valve seat support 21 may additionally be accomplished by way of a sealing ring 22. Valve seat support 21 possesses, over its entire axial extension, an inner passthrough opening 24 which runs concentrically with longitudinal valve axis 8. With its lower end 25, which also simultaneously constitutes the downstream termination of the entire fuel injection valve, valve seat support 21 surrounds a valve seat element 26 fitted into passthrough opening 24. Arranged in passthrough opening 24 is valve needle 20, for example rod-shaped and having a circular cross section, which has at its downstream end a valve closure segment 28 serving as a valve closure member. This valve closure segment 28, which for example tapers conically or spherically, coacts in known fashion with a valve seat surface 29, provided in valve seat element 26 and tapering in the flow direction in, for example, a truncated conical shape, which is configured downstream in the axial direction from a guide opening 30 present in valve seat element 26. At least one, but for example also two or four, discharge openings 32 for fuel is or are provided downstream from valve seat surface 29 in valve seat element 26. Flow regions (not depicted) in the form of depressions, grooves, or the like, which ensure unimpeded fuel flow from passthrough opening 24 to valve seat surface 29, are provided in guide opening 30 or in valve needle 20.

The arrangement shown in the FIGURE of lower housing part 18, valve seat support 21, and the movable valve part (armature 19, valve needle 20) represents only one possible embodiment of the valve assembly which follows the magnetic circuit in the downstream direction. A very wide variety of valve assemblies can be used. In addition to so-called inward-opening valve assemblies, it is also possible to use valve assemblies of an outward-opening fuel injection valve. Spherical valve closure elements or perforated spray disks are also conceivable, for example, in such valve assemblies.

The fuel injection valve is actuated electromagnetically in a conventional fashion. The electromagnetic circuit having magnet coil 1, core 2, and armature 19 serves to move valve needle 20 axially and thus to open the fuel injection valve against the spring force of a return spring 33 arranged in the interior of sleeve 10, or to close it. Armature 19 is joined to the end of valve needle 20 facing away from valve closure segment 28 by, for example, a weld bead, and aligned on core 2. Guide opening 30 of valve seat element 26 serves to guide valve needle 20 during its axial movement, together with armature 19, along longitudinal valve axis 8. Armature 19 is guided in the accurately fabricated nonmagnetic spacer 4 during its axial movement.

An adjusting sleeve 38 is slid, pressed, or screwed into an inner flow bore 37 of sleeve 10, running concentrically with longitudinal valve axis 8, which serves to convey fuel toward valve seat surface 29. Adjusting sleeve 38 is used to adjust the spring preload of return spring 33 resting against adjusting sleeve 38, which in turn is braced with its opposite end against a setback 39 of armature 19 mounted on valve needle 20. Provided in armature 19 are one or more annular or bore-like flow conduits 40 through which fuel can pass out from flow bore 37 into passthrough opening 24. Alternatively, polished segments on valve needle 20 are also conceivable, so that flow conduits 40 in armature 19 would no longer be necessary. Projecting into flow bore 37 of sleeve 10 on the inflow side is a fuel filter 42 which filters out those fuel constituents which, because of their size, might cause clogging or damage in the fuel injection valve. Fuel filter 42 is immobilized in housing part 14, for example by being pressed in.

The linear stroke of valve needle 20 is defined by valve seat element 26 and core 2. One end position of valve needle 20, when magnet coil 1 is not energized, is defined by contact of valve closure segment 28 against valve seat surface 29 of valve seat element 26, while the other end position of valve needle 20, when magnet coil 1 is energized, results from contact of armature 19 against core 2. The surfaces of the components in this contact region are, for example, chrome-plated.

Electrical contact to magnet coil 1, and thus excitation thereof, are accomplished by contact elements 43 which are additionally equipped, even outside the actual coil body 3 made of plastic, with an injection-molded plastic sheath 45. Injection-molded plastic sheath 45 can also extend over further components (e.g. housing parts 14 and 18) of the fuel injection valve. Extending out of injection-molded plastic sheath 45 is an electrical connector cable 44 through which power flows to magnet coil 1. Core 2 is tubular, but is not embodied entirely with a constant outside diameter. Only in the region of the axial extension of coil body 3 does core 2 possess a constant outside diameter over its entire axial extension. Above coil body 3, core 2 is configured with a radially outward-facing collar 46 which extends partially in the fashion of a cover over magnet coil 1. Injection-molded plastic sheath 45 projects through a groove in collar 46.

Valve seat support 21 has, facing away from valve seat element 26, a mounting segment 55 with which it projects into a mounting opening 56 of lower housing part 18 and which has a shoulder 57, facing toward valve seat element 26, on which flanged rim 17 engages. Facing away from valve seat element 26, mounting segment 55 terminates at an end surface 60. End surface 60 is aligned on an end setback 61 of mounting opening 56. Clamped in the space of mounting opening 56 lying between end surface 60 and end setback 61 is a cup spring 62 which rests with a radially outer region against end setback 61 and with a radially inner region against end surface 60, and which acts to press mounting segment 55 of valve seat support 21 against flanged rim 17 of lower housing part 18. Cup spring 62 has a central aperture 65 through which valve needle 20 projects, and from which a spring rim 66 extends radially with an S-shaped profile. The S-shape of spring rim 66 results in parallel contact of the contact surfaces of spring rim 66 against end surface 60 and end setback 61, so that cup spring 62 does not dig into end surface 60 or end setback 61 in these regions. In order to improve fuel flow, it may be advantageous to provide at least one rim aperture 67 in spring rim 66, i.e. to perforate spring rim 66 or to structure it with radial spring arms.

The desired and predetermined reference stroke $H_{soll}$ of valve needle 20 that occurs when magnet coil 1 is energized is defined, in the present exemplary embodiment, by the axial spacing between an upper armature end surface 70 of armature 19 and lower end surface 11 of core 2, against which armature 19 comes to rest when magnet coil 1 is energized. During assembly of the fuel injection valve, mounting segment 55 of valve seat support 21 is inserted against the force of cup spring 62 into adjusting segment 71, surrounding mounting opening 56, of lower housing part 18 until it assumes a predetermined position in the axial direction. In this predetermined position, mounting segment 55 can be retained with respect to mounting opening 56 by way of a press fit, for example, or, as depicted in the exemplary embodiment in the FIGURE, by flanged rim 17. In this predetermined position, the effective stroke $H_{eff}$ of valve closure member 28 is still greater than the predetermined reference stroke $H_{soll}$.

By way of a displacement measurement system 72, for example an electrical one, that is arranged in the vicinity of armature 19 in inner flow bore 37, or a displacement measurement system 72', for example an electrical one, that is arranged in the vicinity of discharge opening 32 and is aligned on valve closure segment 28, the effective stroke $H_{eff}$ of armature 19, which is equivalent to the effective stroke $H_{eff}$ of valve closure segment 28, is then determined, during an excitation of magnet coil 1, by way of the (for example electrical) displacement system 72 or 72', and supplied to an electronic control device 75 as an electrical signal. The measured effective stroke $H_{eff}$ is then compared in electronic control device 75 to the desired reference stroke $H_{soll}$, and if there is a difference between these values, control device 75 activates a welding device 76, for example a laser welding device, which applies a first weld bead 50 circumferentially around adjusting segment 71 of lower housing part 18.

As it cools, first weld bead 50 shrinks against the force of cup spring 62 by a few micrometers, so that the axial spacing between lower end surface 11 of core 2 and upper armature end surface 70, and thus the effective stroke $H_{eff}$, is reduced by that amount. In a second measurement operation, magnet coil 1 is energized again and the effective stroke $H_{eff}$ is measured by way of the (for example electrical) displacement measurement system 72 or 72' and compared in electronic control device 75 to the predetermined reference stroke $H_{soll}$. If a difference still exists between the effective stroke $H_{eff}$ and the reference stroke $H_{soll}$, a second weld bead 51 is generated on adjusting segment 71 by way of electronic control device 75 and welding device 76, resulting, after cooling, in a further reduction in the effective stroke $H_{eff}$ of valve needle 20. This second weld bead 51 can also be configured in completely circumferential fashion, or can be circumferential but with interruptions between the individual weld bead segments in order to achieve more sensitive adjustment. If this effective stroke $H_{eff}$ is still different from the reference stroke $H_{soll}$, a third weld bead 52 can be applied in a further measurement and adjustment cycle of the kind described above. If necessary, further measurement and adjustment cycles can also be performed in order to generate further weld beads. Third weld bead 52 or the further weld beads can also, depending on the need for sensitive adjustment, be embodied in completely circumferential fashion or with interruptions between individual weld bead segments. It is also possible to generate multiple weld beads one behind another in one measurement and adjustment cycle.

The measurement and adjustment cycle described above for adjusting the reference stroke $H_{soll}$ of valve closure member 28 can take place in an automated process on the completely assembled fuel injection valve. The adjusting steps in the micrometer range allow extremely exact adjustment of the reference stroke $H_{soll}$ to very close tolerances.

What is claimed is:

1. A fuel injection valve for a fuel injection system of an internal combustion engine, comprising:

a valve seat support;

a valve seat element situated in the valve seat support, the valve seat element having a valve seat surface;

a valve closure member coacting with the valve seat surface;

a magnet coil;

an armature for actuating the valve closure member;

a valve housing having an adjusting segment facing toward the valve seat element, the valve housing, with the adjusting segment, resting, continuously in a circumferential direction, on the valve seat support;

a cup spring engaging on the valve seat support and engaging, facing away from the valve seat support, on the valve housing; and at least one circumferential weld joining the adjusting segment to the valve seat support.

2. The fuel injection valve according to claim 1, wherein the fuel injection valve is for a direct injection of a fuel into a combination chamber of the internal combustion engine.

3. The fuel injection valve according to claim 1, wherein the valve seat support has a shoulder, the adjusting segment has a flanged rim, and the shoulder engages on the flanged rim.

4. The fuel injection valve according to claim 1, wherein the cup spring has a central aperture and has a spring rim extending in an S-shape.

5. The fuel injection valve according to claim 4, wherein the spring rim has at least one rim aperture.

6. The fuel injection valve according to claim 1, wherein the at least one weld is completely circumferential.

7. The fuel injection valve according to claim 1, wherein the at least one weld includes weld segments with interruptions therebetween.

8. The fuel injection valve according to claim 1, wherein there is an immobilization between the valve seat support and the valve housing so that a linear stroke of the valve closure member is greater in a preliminary setting than a reference stroke.

9. The fuel injection valve according to claim 1, wherein the at least one circumferential weld includes a plurality of weld beads on the adjusting segment of the valve housing so that a reference stroke of the valve closure member is adjustable in adjusting steps that each lie in a micrometer range.

10. A method for manufacturing a fuel injection valve for a fuel injection system of an internal combustion engine, the fuel injection valve having a valve housing, a magnet coil, an armature, a valve closure member being activated via the armature and coacting with a valve seat surface, a valve seat element having the valve seat surface and being situated in a valve seat support, and a cup spring engaging on the valve seat support, the method comprising the steps of:

arranging the cup spring in the valve housing;

subsequently introducing the valve seat support at least partially into an adjusting segment of the valve housing against a force of the cup spring until a predetermined position is reached, and retaining the valve seat support in the predetermined position;

subsequently energizing the magnet coil, measuring an effective stroke of the valve closure member and comparing the effective stroke to a reference stroke; and if a difference exists between the effective stroke and the reference stroke, applying at least one weld on the adjusting segment of the valve seat support.

11. The method according to claim 10, wherein the at least one weld is an interrupted circumferential weld.

12. The method according to claim 10, wherein the at least one weld is a continuously circumferential weld.

13. The fuel injection valve according to claim 10, wherein the fuel injection valve is for a direct injection of a fuel into a combination chamber of the internal combustion engine.

14. The method according to claim 10, further comprising the steps of, after the applying step:

energizing the magnet coil again, measuring the effective stroke of the valve closure member and comparing the effective stroke to the reference stroke; and if a difference exists between the effective stroke and the reference stroke, applying at least one additional weld to the adjusting segment of the valve seat support.

15. The method according to claim 10, wherein when the fuel injection valve is assembled, there is an immobilization between the valve seat support and the valve housing so that a linear stroke of the valve closure member is greater in a preliminary setting than a reference stroke.

16. The method according to claim 10, wherein the step of applying at least one weld is repeated to provide a plurality of weld beads on the adjusting segment of the valve housing so that a reference stroke of the valve closure member is adjustable in adjusting steps that each lie in a micrometer range.

* * * * *